US012331517B2

(12) United States Patent
Chen et al.

(10) Patent No.: US 12,331,517 B2
(45) Date of Patent: Jun. 17, 2025

(54) COMPOSITE WALL BEING LIGHTWEIGHT, EASY TO BE PREFABRICATED AND CONVENIENT FOR ON-SITE CONSTRUCTION

(71) Applicant: HAINAN UNIVERSITY, Hainan (CN)

(72) Inventors: Yun Chen, Hainan (CN); Yubo Liu, Hainan (CN); Yunlong Zheng, Hainan (CN)

(73) Assignee: HAINAN UNIVERSITY, Hainan (CN)

( * ) Notice: Subject to any disclaimer, the term of this patent is extended or adjusted under 35 U.S.C. 154(b) by 0 days.

(21) Appl. No.: 18/892,602

(22) Filed: Sep. 23, 2024

(65) Prior Publication Data

US 2025/0137252 A1 May 1, 2025

(51) Int. Cl.
*E04B 2/86* (2006.01)
*E04C 2/288* (2006.01)

(52) U.S. Cl.
CPC ..... *E04B 2/86* (2013.01); *E04C 2/288* (2013.01)

(58) Field of Classification Search
CPC ..... E04C 2002/008; E04C 2002/045; E04C 2002/047; E04C 2002/048; E04C 2002/3477; E04C 2/04; E04C 2/044; E04C 2/049; E04C 2/06; E04C 2/243; E04C 2/26; E04C 2/246; E04C 2/28; E04C 2/284; E04C 2/288; E04C 2/296; E04C 2/34; E04B 2/562; E04B 2/86; E04B 2/8611;

(Continued)

(56) References Cited

U.S. PATENT DOCUMENTS 1,069,821 A * 8/1913 Sherwood ..... E04G 17/0658 52/378
3,415,028 A * 12/1968 Nerem ..... E04C 2/284 52/309.3

(Continued)

FOREIGN PATENT DOCUMENTS

AT 508759 A4 * 4/2011 ..... E04B 2/90
CN 203867054 U 10/2014

(Continued)

OTHER PUBLICATIONS

CNIPA First Office Action corresponding to Application No. 202311407438.7; Issued date of Mar. 28, 2024.

(Continued)

*Primary Examiner* — Kyle J. Walraed-Sullivan
(74) *Attorney, Agent, or Firm* — Yue (Robert) Xu; Apex Attorneys at Law, LLP

(57) ABSTRACT

The present application relates to the technical field of building walls and provides a composite wall being lightweight, easy to be prefabricated and convenient for on-site construction. By making the composite wall such that a decorative layer and a formwork are overhung on both sides of a core concrete layer, it is formed a structure similar to a core-wall and steel structure that has rigidity and is elastically deformable. A thermal insulation layer is filled between the decorative layer and the core concrete layer which are connected by a precast outer cantilever rod. The amount of concrete in the prefabricated part of the composite wall is greatly reduced. The composite wall does not require flipping in the prefabrication process and has a significantly shortened production cycle.

7 Claims, 3 Drawing Sheets

(58) Field of Classification Search
CPC .... E04B 2/8617; E04B 2/8635; E04B 2/2647; E04B 2002/565; E04G 17/065; E04G 17/0655; E04G 17/0658; E04G 17/07555; E04G 17/0758
See application file for complete search history.

(56) References Cited

U.S. PATENT DOCUMENTS 3,881,292 A * 5/1975 Porter ..... E04B 1/7612 52/471
3,949,529 A * 4/1976 Porter ..... E04C 2/296 52/309.9
4,224,773 A * 9/1980 Schworer ..... E04C 2/284 52/406.1
4,603,527 A * 8/1986 Vercelletto ..... E04C 2/288 52/712
4,680,913 A * 7/1987 Geisen ..... E04B 1/66 52/746.1
4,885,888 A * 12/1989 Young ..... E04B 1/86 52/564
5,323,578 A * 6/1994 Chagnon ..... E04B 2/8647 249/40
5,497,592 A * 3/1996 Boeshart ..... E04G 17/0654 249/43
5,673,525 A * 10/1997 Keith ..... F16B 19/14 411/487
5,809,723 A * 9/1998 Keith ..... F16B 15/0015 411/475
6,138,981 A * 10/2000 Keith ..... E04G 11/18 249/19
6,263,638 B1 * 7/2001 Long, Sr. ..... B28B 23/028 52/794.1
9,631,360 B2 * 4/2017 Ter-Borch ..... E04B 1/7637
2004/0068948 A1 * 4/2004 Wrass ..... E04B 1/90 52/309.7
2004/0206045 A1 * 10/2004 Foderberg ..... E04F 13/0803 52/506.01
2008/0282634 A1 * 11/2008 Qu ..... E04G 11/18 52/309.11
2009/0007519 A1 * 1/2009 Keshishian ..... E04C 2/044 52/794.1
2009/0277119 A1 * 11/2009 Holm ..... E04B 1/7612 52/506.05
2010/0319295 A1 * 12/2010 Nelson ..... E04C 5/20 52/698
2011/0011024 A1 * 1/2011 Pellicer ..... E04C 5/08 52/698
2011/0154764 A1 * 6/2011 Wang ..... E04C 2/288 52/309.1
2011/0250035 A1 * 10/2011 Goldberg ..... E04B 2/707 411/366.1
2014/0065349 A1 * 3/2014 Kwan ..... E04C 2/044 428/138
2015/0184388 A1 * 7/2015 Ciuperca ..... E04C 2/288 52/745.11
2016/0053479 A1 * 2/2016 Ciuperca ..... E04C 2/044 52/700
2016/0130820 A1 * 5/2016 Cullen ..... E04C 2/284 52/745.1
2016/0222660 A1 * 8/2016 Smith ..... E04C 2/34
2017/0218614 A1 * 8/2017 Ciuperca ..... E04G 9/06
2017/0225432 A1 * 8/2017 Kyriakouleas ..... E04F 13/0875
2019/0256421 A1 * 8/2019 Daubresse ..... E04C 2/288
2019/0257088 A1 * 8/2019 Ciuperca ..... E04G 21/06
2022/0034090 A1 * 2/2022 Espada ..... E04B 1/14
2023/0128237 A1 * 4/2023 Ciuperca ..... C04B 28/08 52/378

FOREIGN PATENT DOCUMENTS

CN 105064555 A 11/2015
CN 109356301 A * 2/2019 ..... E04B 2/00
CN 111236499 A 6/2020
CN 111663766 A * 9/2020 ..... E04G 11/08
CN 112127507 A * 12/2020 ..... E04B 1/7604
CN 112459346 A 3/2021
CN 112554356 A * 3/2021 ..... A01G 9/02
CN 112554391 A * 3/2021 ..... E04B 1/76
CN 112554392 A * 3/2021 ..... E04B 1/76
CN 112609873 A * 4/2021 ..... E04B 2/84
CN 112609874 A 4/2021
CN 212866463 U 4/2021
CN 115095053 A 9/2022
CN 217557315 U 10/2022
CN 117344936 A * 1/2024 ..... E04B 1/41
DE 3517669 A * 5/1986 ..... E04B 1/762
DE 4131102 A1 * 3/1993 ..... B32B 7/08
DE 10205205 A1 * 8/2003 ..... E04C 2/06
DE 202006019663 U1 * 4/2007 ..... B32B 5/26
DE 102012017529 A1 * 3/2014 ..... A44B 18/0003
DE 102018122202 A1 * 3/2020 ..... E04B 2/8617
EP 625618 A2 * 11/1994 ..... E04B 2/92
EP 2136010 A1 * 12/2009 ..... E04B 1/26
EP 2264256 A2 * 12/2010 ..... E04B 2/8611
EP 2377660 A1 * 10/2011 ..... B28B 23/005
EP 3399120 A1 * 11/2018 ..... E04G 17/0652
EP 3712340 A1 * 9/2020 ..... E02D 29/045
FR 2547848 A * 12/1984 ..... E04B 1/76
FR 3116289 A1 * 5/2022 ..... B63B 3/68
GB 2243167 A * 10/1991 ..... E04C 2/284
HK 1180525 A2 * 10/2013 ..... E04C 2/044
KR 2015073443 A * 7/2015 ..... E04B 1/16
KR 2018066442 A * 6/2018 ..... E04B 2/847
KR 2018085151 A * 7/2018 ..... E04G 17/0658
WO 2007134517 A1 11/2007
WO WO-2019113273 A1 * 6/2019 ..... B32B 11/04
WO WO-2020079479 A1 * 4/2020 ..... B32B 13/04
WO WO-2024193875 A1 * 9/2024 ..... E04C 2/24

OTHER PUBLICATIONS

Jianguo Zhang et al, Key technologies for integrated precast concrete exterior wall structure, insulation and decoration China Concrete , Apr. 20, 2024, No. 70, pp. 42-48.

* cited by examiner

COMPOSITE WALL BEING LIGHTWEIGHT, EASY TO BE PREFABRICATED AND CONVENIENT FOR ON-SITE CONSTRUCTION

CROSS REFERENCE TO RELATED APPLICATIONS

This application claims priority to Chinese Patent Application No. 202311407438.7, titled "COMPOSITE WALL BEING LIGHTWEIGHT, EASY TO BE PREFABRICATED AND CONVENIENT FOR ON-SITE CONSTRUCTION", filed on Oct. 27, 2023 with the China National Intellectual Property Administration, which is incorporated herein by reference in its entirety.

FIELD OF THE INVENTION

The present application relates to the technical field of building walls, more particularly, to a composite wall that is lightweight, easy to be prefabricated and convenient for on-site construction.

BACKGROUND

A composite wall, like a composite panel, is a kind of semi prefabricated wall. The panels on both sides of a wall body are poured in a prefabrication plant and connected by a reinforcement cage. After being transported to the site, concrete is filled between the two panels to form a complete wall.

The composite wall is formed by two layers of concrete connected by the reinforcement cage. There are two methods for prefabricating the composite wall. In a first method, a core mold is used to form a cavity in the concrete, so that the concrete poured horizontally during prefabrication is divided into two layers. In a second method, a layer of concrete is poured horizontally and a reinforcement cage is implanted, and then is turned over after it is solidified, and another layer of concrete is poured underneath it. Since the quality of the composite wall produced by the first method is poor (cracks or severe sticking often occurs when the small core mold is pulled out), the second method is currently mainly used.

Ideally, for semi prefabricated building components such as a composite wall and a composite panel, the concrete of the prefabricated part should be as small as possible, which can greatly reduce the workload of storage, transportation and hoisting, but it does not so in actual operation. The thickness of a single layer of concrete in the prefabricated part of either a composite panel or a composite wall is usually ten centimeters. This is because, in order to improve construction efficiency, the entire composite panel or composite wall has a large area, which means low rigidity. Moreover, unlike glass, the prefabricated plate-shaped building material does not have a protective frame, and the strength of concrete is also much lower than that of metal or glass. Therefore, the prefabricated part of these building materials must be very thick to avoid damage during movement or collision. In addition to movements or collisions during storage, transportation and hoisting, there are also various problems caused by pulling out the core mold or flipping during the prefabrication stage (at this time the concrete has not yet cured to its maximum strength). Therefore, the concrete in the prefabrication part is thicker, and occupy more than half of the thickness of the entire wall.

In addition, the structure and the production process of the composite wall also bring great difficulties in integrating a decorative layer and a thermal insulation layer on the wall.

For the prefabricated wall, integrating the decorative layer and the thermal insulation layer onto the wall can greatly reduce the workload of on-site construction. However, the structure of the composite wall which is a semi prefabricated wall is not suitable for integrating the decorative layer and the thermal insulation layer;

For the thermal insulation layer, it is easy to fall off or be damaged during transportation and installation if the thermal insulation layer is arranged on the outside of the composite wall. If the thermal insulation layer is arranged inside, it will be penetrated back and forth by tie bars of the reinforcement cage, and holes allow wind to enter (steel bars and the thermal insulation layer are not tightly fitted with gaps therebetween) and thus cause convective heat loss, and the steel bars form a cold bridge.

For the decorative layer, considering that the composite wall needs to be turned over during the production process, like spreading pancakes, collisions are inevitable. If the decorative layer is arranged on the outer surface of the concrete layer which is poured first, the decorative layer such as tiles is inevitably damaged during the flipping process (because the concrete has not yet cured to a maximum strength, and the tiles are easy to fall off or form hollows). If the decorative layer is arranged on the outer surface of the concrete layer which is poured later, the tiles will be damaged or tilted by an overturned composite wall which presses the decorative layer.

A formwork for concrete is mainly made of wood, which is elastic. Even if it is a steel formwork, it is an elastic structure generally having square steel tube transverse ribs and dorsal bars.

SUMMARY

A composite wall that is lightweight, easy to be prefabricated and convenient for on-site construction is provided according to the present application.

The technical problem to be solved is that concrete of a prefabricated part in a composite wall is too thick and it is difficult to integrate a decorative layer or a thermal insulation layer in the composite wall.

To solve the above technical problem, the present application provides a composite wall being lightweight, easy to be prefabricated and convenient for on-site construction includes a core concrete layer, an outer overhanging decorative layer cantilevered on a side of the core concrete layer close to the outer side of a building through a precast outer cantilever rod, an inner overhanging formwork cantilevered on a side of the core concrete layer close to the inner side of the building through an integrated inner cantilever rod, a pre-perforated thermal insulation layer arranged between the core concrete layer and the outer overhanging decorative layer, and a reinforcement cage arranged between the core concrete layer and the inner overhanging formwork.

A precast adhesive layer for bonding the outer overhanging decorative layer and the pre-perforated thermal insulation layer is filled between the outer overhanging decorative layer and the pre-perforated thermal insulation layer. The precast adhesive layer is a cement mortar with a steel wire mesh or an external wall tile adhesive with a steel wire mesh, and the precast adhesive layer is connected to the core concrete layer through the precast outer cantilever rod. The precast outer cantilever rod includes an outer-cantilever-rod anti-pulling core having two ends respectively located in the core concrete layer and the precast adhesive layer. Clamping pieces for clamping the pre-perforated thermal insulation layer are detachably fixed to the outer-cantilever-rod anti-pulling core.

One end of the integrated inner cantilever rod supports the inner side of the inner overhanging formwork to form a cavity for pouring concrete during on-site assembly, and the other end of the integrated inner cantilever rod is wrapped in the core concrete layer and fixedly connected to the outer-cantilever-rod anti-pulling core in a detachable manner. The inner overhanging formwork is fixedly connected to the integrated inner cantilever rod in a detachable manner.

In a prefabricated state, the composite wall is horizontally arranged and is laminated upward layer by layer with the overhanging decorative layer as a bottommost layer. The core concrete layer flows down along a reserved hole in the pre-perforated thermal insulation layer and is connected to the precast adhesive layer that is not finally solidified, and concrete in the reserved hole and the outer-cantilever-rod anti-pulling core together form the precast outer cantilever rod.

In an embodiment, in storage and transportation states, a plurality of the composite walls are stacked vertically or at an angle that is not 90 degrees to the ground. The stacked composite walls are tied together, with the outer overhanging decorative layer of the composite wall being clamped between the pre-perforated thermal insulation layer thereof and the inner overhanging formwork of another composite wall.

The inner overhanging formwork is an integrated metal formwork with a square tube transverse rib and a square tube dorsal bar, or an integrated wooden formwork with a square wood transverse rib and a square wood dorsal bar, or a wooden formwork having no transverse rib and dorsal bar. The inner overhanging formwork is detachably fixed to the precast outer cantilever rod through a countersunk screw or a bolt having a flexible nut protective cap.

In an embodiment, concrete in the precast outer cantilever rod is thermal insulation concrete, and the outer-cantilever-rod anti-pulling core is made of fiber reinforced plastics.

In an embodiment, the overhanging decorative layer is a tile, and a mesh pad is provided between the overhanging decorative layer and the pre-perforated thermal insulation layer to control a thickness of the precast adhesive layer and ensure that the steel wire mesh is located in the middle of the precast adhesive layer. The mesh pad is provided with a groove matched with the steel wire mesh, and the steel wire mesh is embedded in the groove and is supported by the mesh pad during a pouring process of the precast adhesive layer.

In an embodiment, the composite wall is used as an exterior wall of a high-rise building, and the tile and the mesh pad are fixedly connected by bolting or a mortise joint.

In an embodiment, the reinforcement cage includes two layers of reinforcing mesh and a tie bar arranged between the two layers of reinforcing mesh for connecting the two layers of reinforcing mesh. One of the two layers of reinforcing mesh is buried in the core concrete layer, and two ends of the tie bar are bent into hooks that hook the two layers of reinforcing mesh.

In an embodiment, the outer-cantilever-rod anti-pulling core includes a U-shaped core for connecting the reinforcement cage and the precast adhesive layer, a bolt core for connecting the integrated inner cantilever rod and the precast adhesive layer, and a tie core for connecting the core concrete layer and the precast adhesive layer. A lower end of the outer-cantilever-rod anti-pulling core is an arrow which facilitates passing through the reserved hole of the pre-perforated thermal insulation layer and enhances an anti-pulling force. The U-shaped core is arranged on the reinforcement cage and has no clamping piece provided thereon. An upper end of the bolt core is screwed at a lower end of the integrated inner cantilever rod, and an upper end of the tie core is wavy, threaded or pier-shaped for enhancing the anti-pulling force.

In an embodiment, the outer-cantilever-rod anti-pulling core is provided with a limit protrusion or a limit groove for preventing the clamping pieces from sliding up and down. The reserved hole in the pre-perforated thermal insulation layer is a rectangular hole. Of two clamping pieces provided on the same outer-cantilever-rod anti-pulling core, a lower clamping piece is a rectangular plate with a size smaller than a size of the reserved hole to facilitate passing through the reserved hole. A length of the lower clamping piece is greater than a width of the cross section of the rectangular hole, so that the lower clamping piece is stuck below the pre-perforated thermal insulation layer by rotating 90 degrees after passing through the rectangular hole. A size of an upper clamping piece is larger than the size of the reserved hole to prevent the upper clamping piece from falling.

In an embodiment, a demoulding layer is provided on the inner side of the inner overhanging formwork to prevent the inner overhanging formwork from being unable to be removed after concrete is poured between the inner overhanging formwork and the core concrete layer, and the demoulding layer is a demoulding agent, a plastic film, an isolation cloth, or an isolation paper.

Compared with the conventional technology, the composite wall being lightweight, easy to be prefabricated, and convenient for on-site construction according to the present application has the following beneficial effects.

In the present application, the composite wall is formed by cantilevering the decorative layer and the formwork on both sides of the core concrete layer, which forms a structure similar to a core-wall and steel structure that has rigidity and is elastically deformable. The amount of concrete in the prefabricated part of the composite wall is greatly reduced, and the self-weight is reduced to less than half of that of a conventional composite wall.

In the present application, a flipping equipment is not required in the prefabrication process of the composite wall, and the production cycle is significantly shortened (without waiting for solidification of a first layer of concrete), and the yield rate is improved (the composite wall is not partially damaged by turning over).

According to the composite wall of the present application, it is not easily damaged during the prefabrication stage since flipping is not required. During the storage or transportation stage, since the decorative layer is sandwiched between the thermal insulation layer and a formwork of another composite wall (both are elastic), the composite wall is not easily damaged. During the hoisting stage, since the thermal insulation layer is arranged between the decorative layer and the load-bearing part (the core concrete layer and the reinforcement cage), the composite wall is not easily damaged. The decorative layer can be integrated into the composite wall. The thermal insulation layer is sandwiched between the core concrete layer and the decorative layer, and is not easy to fall off or be damaged. The connector that passes through the thermal insulation layer is the precast outer cantilever rod, reliable connection can be achieved (the precast outer cantilever rod is directly integrated with the two parts of concrete, and is unlike a conventional embedded part which realize the connection only by holding force of concrete) and air leakage is avoided. No cold bridge is formed (the thermal conductivity of thermal insulation concrete and fiber reinforced plastics is much lower than that of metal). Thus, the decorative layer and the thermal insulation layer are integrated into the composite wall without damaging the decorative layer and without affecting the insulation effect of the thermal insulation layer, which greatly reduces the workload of on-site construction.

Reference signs in the figures are listed as follows:

1—core concrete layer,
2—outer overhanging decorative layer,
3—inner overhanging formwork,
4—pre-perforated thermal insulation layer,
5—precast adhesive layer,
6—precast outer cantilever rod,
7—integrated inner cantilever rod,
8—reinforcement cage.
51—steel wire mesh,
52—mesh pad,
61—outer-cantilever-rod anti-pulling core,
62—clamping piece.

DETAIL DESCRIPTION OF EMBODIMENTS

Figure 1:
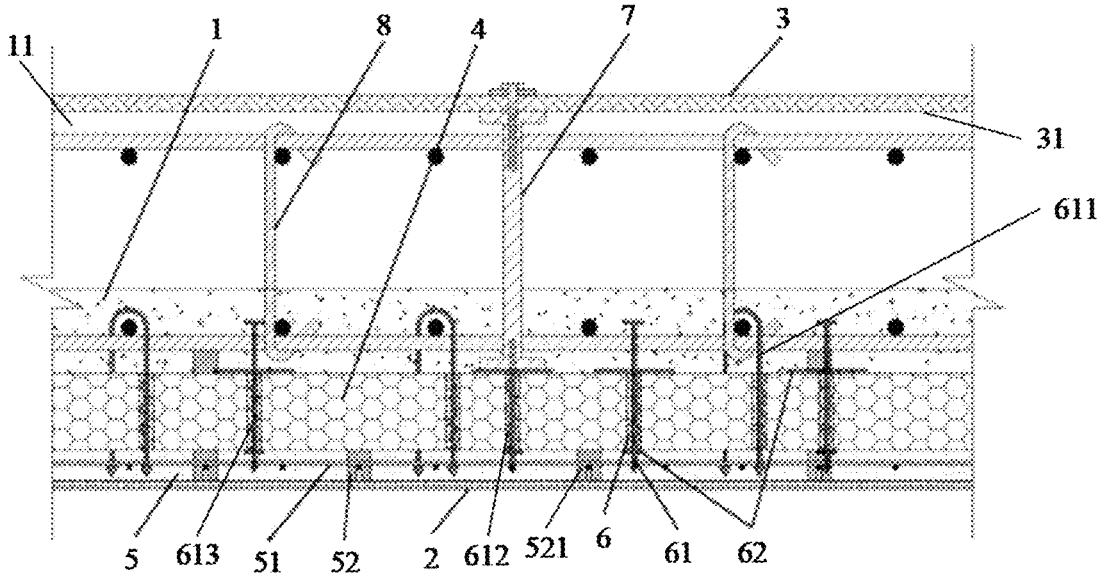
FIG. 1 is a structural schematic view of a composite wall that is a lightweight, easy to be prefabricated, and convenient for on-site construction according to the present application.

As shown in FIG. 1, there is provided a composite wall that is lightweight, easy to be prefabricated, and convenient for on-site construction. The composite wall includes: a core concrete layer 1; an outer overhanging decorative layer 2 cantilevered on a side of the core concrete layer 1 close to the outer side of a building by means of a precast outer cantilever rod 6; an inner overhanging formwork 3 cantilevered on a side of the core concrete layer 1 close to the inner side of the building by means of an integrated inner cantilever rod 7; a pre-perforated thermal insulation layer 4 arranged between the core concrete layer 1 and the outer overhanging decorative layer 2; and a reinforcement cage 8 arranged between the core concrete layer 1 and the inner overhanging formwork 3.

The core concrete layer 1 is equivalent to a concrete layer in a conventional composite wall, and the other concrete layer in the conventional composite wall is replaced by the inner overhanging formwork 3. The term "inner overhanging" means that it is located inside the building and can be constructed directly in the building by a builder without the need for working at heights. Since the inner overhanging formwork 3 has been integrated into the composite wall during the prefabrication stage, it is not required to support the formwork during on-site construction. The on-site installation process of this composite wall is the same as that of the conventional composite wall except that there is no need to mount the decorative layer and the thermal insulation layer and the inner overhanging formwork 3 is required to be removed after the concrete has solidified (removing the formwork is a fast and labor-saving operation).

Since the core concrete layer 1 is equivalent to a concrete layer in the conventional composite wall, it has a high rigidity and can form a structure similar to a core-wall and steel structure in the building with the inner cantilever formwork 3 and the outer cantilever decorative layer 2 (the outer cantilever decorative layer 2 is divided into blocks, just like lamellar armors, allows deformation, and can return to its original position under the constraints of an outer-cantilever-rod anti-pulling core 61 and the outer cantilever decorative layer 2 after deformation, so it is elastic) which are on both sides of the core concrete layer 1 respectively and have low rigidity and certain elasticity. The core concrete layer 1 is equivalent to a core wall; the inner cantilever formwork 3 and the outer cantilever decorative layer 2 are equivalent to a steel structure at the periphery of the building; and the connecting structure in the middle is equivalent to a beam of the building.

A precast adhesive layer 5 is filled between the outer overhanging decorative layer 2 and the pre-perforated thermal insulation layer 4 to bond them together. The precast adhesive layer 5 is a cement mortar with a steel wire mesh 51 or an external wall tile adhesive with a steel wire mesh 51. The precast adhesive layer 5 is connected to the core concrete layer 1 via the precast outer cantilever rod 6. The precast outer cantilever rod 6 includes an outer-cantilever-rod anti-pulling core 61 having two ends respectively located in the core concrete layer 1 and the precast adhesive layer 5. Clamping pieces 62 are detachably fixed to the outer-cantilever-rod anti-pulling core 61 to clamp the pre-perforated thermal insulation layer 4.

The precast adhesive layer 5 containing the steel wire mesh 51 cooperates with the precast outer cantilever rod 6 containing the outer-cantilever-rod anti-pulling core 61 to form a structure that can not only fix the decorative layer but also prevent the decorative layer from falling off even if the precast adhesive layer 5 is broken. The precast adhesive layer 5 that is broken is located internally and is not visible from the outside, which does not affect the decorative effect. This is particularly suitable for the case where the outer overhanging decorative layer 2 consists of tiles which are pieced together, instead of a single piece. Thus, the strain generated appears in the precast adhesive layer 5 regardless of whether the tiles or the precast adhesive layer 5 is stressed. The precast adhesive layer 5 is allowed to be broken, and the external force is dissipated after it is broken. That is, the precast adhesive layer 5 not only plays a role of adhesion, but also is a structure that protects the outer fragile tiles through self-sacrifice. The concrete part in the outer-cantilever-rod anti-pulling core 61 of the precast outer cantilever rod 6 is also breakable.

One end of the integrated inner cantilever rod 7 supports the inner side of the inner overhanging formwork 3 to form a cavity 11 for pouring concrete during on-site assembly, and the other end of the integrated inner cantilever rod 7 is embedded in the core concrete layer 1 and detachably fixed to the outer-cantilever-rod anti-pulling core 61. The inner overhanging formwork 3 is detachably fixed to the integrated inner cantilever rod 7.

The inner overhanging formwork 3 is completely supported by the integrated inner cantilever rod 7 during prefabrication. If the pre-perforated thermal insulation layer 4 is relatively soft, it will be pressed to form a pit, which is not conducive to thermal insulation. Therefore, the integrated inner cantilever rod 7 needs to be connected with one outer-cantilever-rod anti-pulling core 61, such that the integrated inner cantilever rod 7 is supported by the outer-cantilever-rod anti-pulling core 61 and the surrounding concrete.

In the prefabricated state, the composite wall is horizontally arranged and is laminated upward layer by layer with the overhanging decorative layer 2 as a bottommost layer. The core concrete layer 1 flows down along reserved holes in the pre-perforated thermal insulation layer 4 and is connected to the precast adhesive layer 5 that is not finally solidified. The concrete in the reserved holes and the outer-cantilever-rod anti-pulling core 61 together form the precast outer cantilever rod 6.

Based on the relative positions of the components, the operations of connection (the outer-cantilever-rod anti-pulling core 61 is very thin and is not enough to achieve the connection alone), cold bridge interruption and convection interruption can be directly completed by the concrete flowing down from the core concrete layer 1, without the need for flipping in the prefabrication process and additional steps.

In storage and transportation states, the composite walls are stacked vertically or at a non-90 degree angle to the ground. The stacked composite walls are bundled together, with the outer overhanging decorative layer 2 of a composite wall being sandwiched between the pre-perforated thermal insulation layer 4 thereof and an inner overhanging formwork 3 of another composite wall.

The inner overhanging formwork 3 is an integrated metal formwork having a square tube transverse rib and a square tube dorsal bar, or an integrated wooden formwork having a square wood transverse rib and a square wood dorsal bar, or a wooden formwork without a transverse rib and a dorsal bar. The inner overhanging formwork 3 is detachably fixed to the precast outer cantilever rod 6 through a countersunk screw or a bolt having a flexible nut protective cap.

The main purpose is to ensure that, during storage and transportation, the inner overhanging formwork 3 in contact with the tiles does not have a member that can break the tiles.

The concrete in the precast outer cantilever rod 6 is thermal insulation concrete (concrete having an aggregate with low thermal conductivity such as pumice, or foamed concrete), and the outer-cantilever-rod anti-pulling core 61 is made of glass fiber reinforced plastics. In this way, the cold bridge can be effectively interrupted. The ordinary concrete and steel outer-cantilever-rod anti-pulling core 61 are also possible, because the thermal conductivity of the ordinary concrete is also very low and the outer-cantilever-rod anti-pulling core 61 is very thin (which itself needs only sufficient tensile strength since the force primarily acts on the concrete outside the outer-cantilever-rod anti-pulling core 61) and thus has low heat conduction.

The overhanging decorative layer 2 consists of tiles, and a mesh pad 52 is provided between the overhanging decorative layer 2 and the pre-perforated thermal insulation layer 4 to control the thickness of the precast adhesive layer 5 and ensure that the steel wire mesh 51 is located in the middle of the precast adhesive layer 5. A groove 521 matched with the steel wire mesh 51 is formed in the mesh pad 52, and the steel wire mesh 51 is embedded in the groove 521 and supported by the mesh pad 52 during the pouring process of the precast adhesive layer 5.

In a case that the composite wall is used as an exterior wall of a high-rise building, the tile and the mesh pad 52 are fixedly connected through bolting or a mortise joint to meet the safety requirements of national standards for the use of tiles in the high-rise building. The term "mortise joint" refers to inserting a tenon which is provided on the mesh pad 52 into a mortise which is provided on the tile. In the embodiment, the mesh pad 52 is provided on its bottom with a cross-shaped groove in which the crisscross portion of the steel wire mesh is tightly arranged, and is then connected to the tile. As such, the tile is reliably pulled by the steel wire mesh 51.

The reinforcement cage 8 includes two layers of reinforcing mesh and a tie bar arranged between the two layers of reinforcing mesh and used to connect the two layers of reinforcing mesh. One layer of reinforcing mesh is buried in the core concrete layer 1, and two ends of the tie bar are bent into hooks that hook the two layers of reinforcing mesh. The hooks are required to support the upper layer of reinforcing mesh to prevent it from falling.

The outer-cantilever-rod anti-pulling core 61 includes a U-shaped core 611 for connecting the reinforcement cage 8 to the precast adhesive layer 5, a bolt core 612 for connecting the integrated inner cantilever rod 7 to the precast adhesive layer 5, and a tie core 613 for connecting the core concrete layer 1 to the precast adhesive layer 5. A lower end of the outer-cantilever-rod anti-pulling core 61 is an arrow for conveniently passing through the reserved hole in the pre-perforated thermal insulation layer 4 and enhancing an anti-pulling force. The U-shaped core is disposed on the reinforcement cage 8 and has no clamping piece 62. An upper end of the bolt core is screwed in the lower end of the integrated inner cantilever rod 7. An upper end of the tie core is wavy, threaded, or pier-shaped for enhancing the anti-pulling force.

The tie core and the U-shaped core respectively connect the concrete in the core concrete layer 1 and the reinforcement cage 8 to the precast adhesive layer 5 to ensure reliable connection. The bolt core can support the integrated inner cantilever rod 7 and prevent the integrated inner cantilever rod 7 from tilting during the pouring of the core concrete layer 1.

Figure 2:
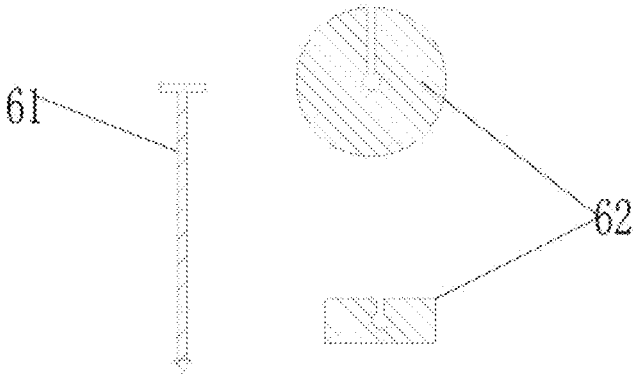
FIG. 2 is a structural explosion view of an outer-cantilever-rod anti-pulling core.
Figure 3:
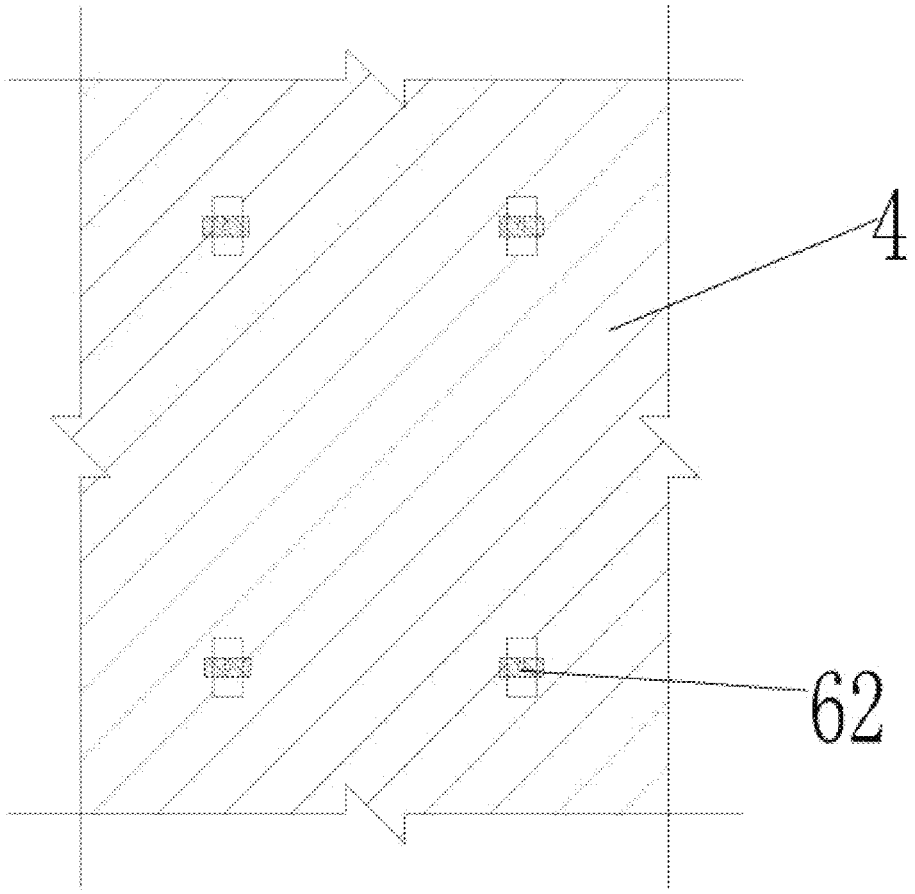
FIG. 3 is a schematic view showing the relative position of the reserved hole in a pre-perforated thermal insulation layer and the clamping piece at the bottom of the outer-cantilever-rod anti-pulling core.
Figure 4:
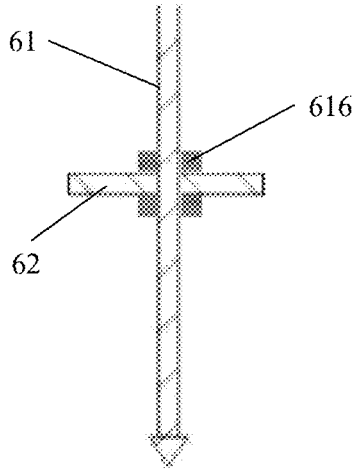
FIGS. 4 and 5 are partial section views showing a limit protrusion and a limit groove according to an embodiment of the present application respectively.
Figure 5:
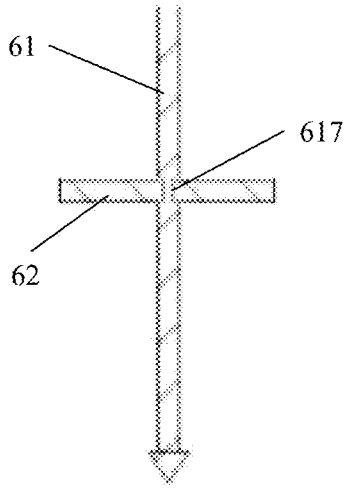

As shown in FIGS. 2 to 3, the outer-cantilever-rod anti-pulling core 61 is provided with a limit protrusion 616 or a limit groove 617 for preventing the clamping piece 62 from sliding up and down. The reserved hole in the pre-perforated thermal insulation layer 4 is a rectangular hole. In the case of two clamping pieces 62 provided with respect for the same outer-cantilever-rod anti-pulling core 61, a lower clamping piece 62 is a rectangular plate with a size smaller than the size of the reserved hole to facilitate the clamping piece 62 to pass through the reserved hole, and has a length greater than the width of the cross section of the rectangular hole so that, after passing through the rectangular hole, the lower clamping piece 62 is stuck below the pre-perforated thermal insulation layer 4 by rotating 90 degrees; and an upper clamping piece 62 has a size larger than the size of the reserved hole to prevent it from falling.

The precast outer cantilever rod 6 is used to connect not only tiles but also the pre-perforated thermal insulation layer 4. The sliding of the pre-perforated thermal insulation layer 4 on the rod cannot be limited by the precast outer cantilever rod 6, and is not suitable for limitation by tiles because this will increase the load exerted on the tiles during use. It is necessary to provide the clamping piece 62 for the purpose of limitation. The clamping piece 62 not only pulls the pre-perforated thermal insulation layer 4, but also prevents the outer-cantilever-rod anti-pulling core 61 from falling during pouring. A slit is formed in the clamping piece 62 to avoid blocking the concrete and facilitate mounting the clamping piece 62 onto the outer-cantilever-rod anti-pulling core 61.

It is not allowed to place the pre-perforated thermal insulation layer 4 on the precast adhesive layer 5 after the clamping piece 62 and the outer-cantilever-rod anti-pulling core 61 are mounted to the pre-perforated thermal insulation layer 4. It is found in actual use that, although the clamping piece 62 does not need to pass through the hole in the pre-perforated thermal insulation layer 4, there is another problem that the outer-cantilever-rod anti-pulling core 61 would be inclined. Since the outer-cantilever-rod anti-pulling core 61 is in clearance fit with the hole in the pre-perforated thermal insulation layer 4, the lower end of the outer-cantilever-rod anti-pulling core 61 is inclined after it is inserted into the precast adhesive layer 5.

A demoulding layer 31 is provided on the inner side of the inner overhanging formwork 3 to prevent the inner overhanging formwork 3 from being unable to be removed after the concrete is poured between the inner overhanging formwork 3 and the core concrete layer 1. The demoulding layer 31 is a demoulding agent, a plastic film, an isolation cloth or an isolation paper.

The prefabrication process of the composite wall according to the present application includes the following steps.

In Step 1, the reinforcement cage 8 is bound; the hole is formed in a thermal insulation layer to form the pre-perforated thermal insulation layer 4; the tile is wet; and the mesh pad 52 is mounted to the steel wire mesh 51.

In Step 2, side formworks of the composite wall are assembled on a formwork platform of a prefabrication site, and an isolation cloth or an isolation paper is laid in a formwork.

In Step 3: the tile having a wet inner surface is laid on the isolation cloth or the isolation paper, with the front face of the tile facing downward and the back face of the tile facing upward.

In Step 4: the steel wire mesh 51 is laid and the precast adhesive layer 5 is poured. The precast adhesive layer 5 may be made of cement mortar with good adhesion or special exterior wall tile glue. The exterior wall tile glue may be made of cellulose, quartz sand, adhesive powder, and high-grade cement. The steel wire mesh 51 in the precast adhesive layer 5 may also be replaced by fiberglass mesh or the like.

In Step 5, the pre-perforated thermal insulation layer 4 is laid, and the tie core and the bolt core are anchored into the precast adhesive layer 5. It should be noted that various kinds of the outer-cantilever-rod anti-pulling cores 61 are required to be anchored into the precast adhesive layer 5 before initial solidification of the precast adhesive layer 5, and the same applies below.

In Step 6, a cushion block is placed on the pre-perforated thermal insulation layer 4; the reinforcement cage 8 is placed on the cushion block; the U-shaped core is anchored into the precast adhesive layer 5; and the integrated inner cantilever rod 7 is mounted.

In Step 7, the core concrete layer 1 is poured. The pouring of the core concrete layer 1 should be carried out after the initial solidification of the precast adhesive layer 5 or after the integrated inner cantilever rod 7 is bound to the reinforcement cage 8 so as to prevent the integrated inner cantilever rod 7 from tilting during the pouring of the core concrete layer 1.

In Step 8, the inner overhanging formwork 3 is mounted.

The embodiments described above are merely descriptions of the preferred implementations of the present application, and are not intended to limit the scope of the present application. Without departing from the design spirit of the present application, various modifications and improvements made to the technical solutions of the present application by those skilled in the art shall fall within the protection scope determined by the claims of the present application.

The invention claimed is:

1. A composite wall, comprising a core concrete layer, an outer overhanging decorative layer cantilevered on a side of the core concrete layer for being located at an outer side of a building by precast outer cantilever rods, an inner overhanging formwork cantilevered on a side of the core concrete layer for being located at an inner side of the building by an integrated inner cantilever rod, a pre-perforated thermal insulation layer arranged between the core concrete layer and the outer overhanging decorative layer, and a reinforcement cage arranged between the core concrete layer and the inner overhanging formwork; wherein a precast adhesive layer is filled between the outer overhanging decorative layer and the pre-perforated thermal insulation layer to bond the outer overhanging decorative layer and the pre-perforated thermal insulation layer, the precast adhesive layer is a cement mortar with a steel wire mesh or an external wall tile adhesive with a steel wire mesh, the precast adhesive layer is connected to the core concrete layer via the precast outer cantilever rods which each comprise an outer-cantilever-rod anti-pulling core having two ends respectively located in the core concrete layer and the precast adhesive layer, clamping pieces are detachably fixed to some of the outer-cantilever-rod anti-pulling cores to clamp the pre-perforated thermal insulation layer;

one of both ends of the integrated inner cantilever rod is configured to support an inner side of the inner overhanging formwork to form a cavity for pouring concrete during on-site assembly, and the other of the both ends of the integrated inner cantilever rod is embedded in the core concrete layer and detachably fixed to one of the outer-cantilever-rod anti-pulling cores, and the integrated inner cantilever rod is detachably fixed to the inner overhanging formwork; and in a prefabricated state, the composite wall is horizontally arranged and is laminated upward layer by layer with the overhanging decorative layer as a bottommost layer, the core concrete layer flows down along reserved holes provided in the pre-perforated thermal insulation layer and is connected to the precast adhesive layer that is not finally solidified, each precast outer cantilever rod is formed of concrete in the corresponding reserved hole and the corresponding outer-cantilever-rod anti-pulling core;

the outer-cantilever-rod anti-pulling cores comprise a U-shaped core for connecting the reinforcement cage to the precast adhesive layer, a bolt core for connecting the integrated inner cantilever rod to the precast adhesive layer, and a tie core for connecting the core concrete layer to the precast adhesive layer, a lower end of each outer-cantilever-rod anti-pulling core is arrow-shaped, which facilitates passing through the reserved hole in the pre-perforated thermal insulation layer and provides an anti-pulling force, the U-shaped core is arranged on the reinforcement cage and has no clamping piece provided thereon, an upper end of the bolt core is screwed in a lower end of the integrated inner cantilever rod, and an upper end of the tie core is shaped to provide the anti-pulling force; and each outer-cantilever-rod anti-pulling core, for which two clamping pieces are provided, is provided with a limit protrusion or a limit groove for preventing the two clamping pieces from sliding up and down, the reserved hole in the pre-perforated thermal insulation layer corresponding to the outer-cantilever-rod anti-pulling core is a rectangular hole; a lower clamping piece of the two clamping pieces provided on a same outer-cantilever-rod anti-pulling core is a rectangular plate with a size smaller than a size of the corresponding reserved hole to facilitate passing through the corresponding reserved hole, and has a length greater than a width of a cross section of the rectangular hole, so that the lower clamping piece is stuck below the pre-perforated thermal insulation layer by rotating 90 degrees after passing through the rectangular hole, and an upper clamping piece of the two clamping pieces has a size larger than the size of the corresponding reserved hole to prevent the upper clamping piece from falling.

2. The composite wall according to claim 1, wherein in storage and transportation states, a plurality of the composite walls are stacked vertically or at a non-90 degree angle to a ground surface; the composite walls, which are stacked, are bundled together, with the outer overhanging decorative layer of a composite wall being sandwiched between the pre-perforated thermal insulation layer thereof and the inner overhanging formwork of another composite wall.

3. The composite wall according to claim 1, wherein concrete in the precast outer cantilever rod is thermal insulation concrete, and the outer-cantilever-rod anti-pulling core is made of fiber reinforced plastics.

4. The composite wall according to claim 1, wherein a mesh pad is provided between the overhanging decorative layer and the pre-perforated thermal insulation layer to control a thickness of the precast adhesive layer and ensure that the steel wire mesh is located in a middle of the precast adhesive layer, the mesh pad is provided with a groove matched with the steel wire mesh, and the steel wire mesh is embedded in the groove and is supported by the mesh pad during a pouring process of the precast adhesive layer.

5. The composite wall according to claim 4, wherein the composite wall is used as an exterior wall of a building, and the overhanging decorative layer and the mesh pad are fixedly connected by bolting or a mortise joint.

6. The composite wall according to claim 1, wherein the reinforcement cage comprises two layers of reinforcing mesh and a tie bar arranged between and connecting the two layers of reinforcing mesh, one of the two layers of reinforcing mesh is buried in the core concrete layer, and two ends of the tie bar are bent into hooks that hook the two layers of reinforcing mesh.

7. The composite wall according to claim 1, wherein a demoulding layer is provided on the inner side of the inner overhanging formwork to enable the inner overhanging formwork to be removed after concrete is poured between the inner overhanging formwork and the core concrete layer, and the demoulding layer is a demoulding agent, a plastic film, an isolation cloth, or an isolation paper.

* * * * *